US011520257B2

(12) United States Patent
Koyama

(10) Patent No.: US 11,520,257 B2
(45) Date of Patent: Dec. 6, 2022

(54) IMAGE FORMING APPARATUS

(71) Applicant: CANON KABUSHIKI KAISHA, Tokyo (JP)

(72) Inventor: Hiroshi Koyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/533,822

(22) Filed: Nov. 23, 2021

(65) Prior Publication Data

US 2022/0187746 A1 Jun. 16, 2022

(30) Foreign Application Priority Data

Dec. 14, 2020 (JP) ..... JP2020-206771

(51) Int. Cl.
*G03G 15/20* (2006.01)
*G03G 21/16* (2006.01)

(52) U.S. Cl.
CPC ..... *G03G 15/2017* (2013.01); *G03G 15/206* (2013.01); *G03G 15/2032* (2013.01); *G03G 21/1623* (2013.01); *G03G 21/1633* (2013.01); *G03G 21/1647* (2013.01); *G03G 21/1685* (2013.01); *G03G 15/2053* (2013.01); *G03G 21/1628* (2013.01); *G03G 2215/00544* (2013.01); *G03G 2215/2003* (2013.01); *G03G 2221/169* (2013.01); *G03G 2221/1639* (2013.01)

(58) Field of Classification Search
CPC ..... G03G 15/0142; G03G 15/2017; G03G 15/2032; G03G 15/2035; G03G 15/2053; G03G 15/206; G03G 21/1609; G03G 21/1623; G03G 21/1628; G03G 21/1633; G03G 21/1638; G03G 21/1642; G03G 21/1647; G03G 21/1685; G03G 2215/0054; G03G 2215/00544; G03G 2215/2003; G03G 2221/1639; G03G 2221/1654; G03G 2221/169
See application file for complete search history.

(56) References Cited

U.S. PATENT DOCUMENTS

| | | | | |
|---|---|---|---|---|
| 10,353,329 | B2 | 7/2019 | Ogasawara | |
| 2007/0077104 | A1* | 4/2007 | Hasegawa | G03G 15/6529 399/328 |
| 2008/0069589 | A1* | 3/2008 | Chang | G03G 21/1685 399/122 |
| 2014/0140727 | A1* | 5/2014 | Shimoi | G03G 21/1633 399/121 |

FOREIGN PATENT DOCUMENTS

| | | |
|---|---|---|
| JP | 2018-106028 | 7/2018 |

* cited by examiner

*Primary Examiner* — Joseph S Wong
(74) *Attorney, Agent, or Firm* — Venable LLP

(57) ABSTRACT

A first protrusion is provided between an operation lever and a lock lever. The operation lever is for moving a pressure roller. The lock lever is provided for a sheet guide member for guiding a sheet that has passed through a fixing unit downstream in the sheet conveyance direction. The lock lever is for locking the sheet guide member at a position where the sheet guide member is engaged with a housing. The first protrusion protrudes from the sheet guide member toward an exterior cover. The first protrusion is provided with a second protrusion on the lock lever side of the first protrusion.

9 Claims, 10 Drawing Sheets

IMAGE FORMING APPARATUS

BACKGROUND OF THE INVENTION

Field of the Invention

The present invention relates an image forming apparatus that forms an image on a sheet.

Description of the Related Art

As an image forming apparatus that forms an image on a sheet, a configuration is conventionally known in which an image formed on a photoconductor member is transferred onto a sheet at a transfer portion, the transferred image is fixed to the sheet at a fixing unit, and the sheet to which the image has been fixed is discharged onto a discharge tray at an upper portion of the image forming apparatus.

In recent years, users have demanded that various types of sheets, such as plain paper and envelopes, should be dealt with. To deal with such various types of sheets, a configuration is known in which an exterior cover at a side of an image forming apparatus (or a back side of an image forming apparatus) is opened to discharge a sheet to which an image has been fixed at a fixing unit is discharged from the side of the image forming apparatus in a horizontal direction.

Further, to deal with sheets, such as envelopes, that have widths, in a direction perpendicular to the sheet conveyance direction, smaller than widths of plain paper, a configuration is disclosed in which a pressure adjustment mechanism that adjusts a nip pressure relative to a sheet in a fixing unit is provided.

Japanese Patent Application Laid-Open No. 2018-106028 discloses a nip pressure adjustment mechanism in which a pair of left and right pressure adjustment levers is provided in the width direction of a sheet. The pressure adjustment levers are operated to adjust a nip pressure between a heating roller and a pressure roller pressed against the heating roller in a fixing unit. By pushing down the pressure adjustment levers, the nip pressure between the heating roller and the pressure roller in the fixing unit is adjusted to make the nip pressure after the pushing down smaller than the nip pressure before the pushing down. The pressure adjustment levers are pushed down to decrease the nip pressure when an envelope that has a width smaller than widths of plain paper is used. The pressure adjustment levers are held at positions after the pushing down at which the nip pressure is smaller than the nip pressure before the pushing down.

Further, in a conventional image forming apparatus, a sheet to which an image has been fixed at a fixing unit is fed to the upper side in a vertical direction along a side of the image forming apparatus from a horizontal direction, and further is fed to a discharge tray at an upper portion of the image forming apparatus. Therefore, in addition to the pressure adjustment mechanism described above, the conventional image forming apparatus is provided with a guide and rollers in a section along the side of the image forming apparatus between the fixing unit and the discharge tray at an upper portion of the image forming apparatus. The guide and rollers feed a sheet fed in the horizontal direction to the upper side in the vertical direction along the side of the image forming apparatus.

Further, the guide is provided openably and closably relative to a main body of the image forming apparatus to remove a sheet that remains in the fixing unit or the section along the side of the image forming apparatus. The guide is provided with disengagement levers that engage the guide with the main body of the image forming apparatus, or disengage the engagement. The disengagement levers are engaged with the main body of the image forming apparatus to hold the guide at a position where the guide guides a sheet in the vertical direction, and the engagement is disengaged to retract the guide from the position where the guide guides a sheet. Further, the guide is also provided with the pressure adjustment levers described above. In the guide engaged with the main body of the image forming apparatus with the disengagement levers, the pressure adjustment levers are provided to the lower side of the disengagement levers in the vertical direction, and at positions closer to the rotational center of the guide than the disengagement levers.

Here, when a sheet that remains in the above-described section is removed, and if the sheet that remains is an envelope, the pressure adjustment levers are held at positions after the pushing down, when the guide is opened. In this case, biasing forces of biasing members that press a heating roller and a pressure roller act on the pressure adjustment levers held at the positions after the pushing down. Therefore, if the pressure adjustment levers are held at the positions after the pushing down when the guide is opened, forces acting on the pressure adjustment levers act as loads that maintain the orientation of the guide, and hinder the guide from being opened although the engagement with the main body of the image forming apparatus is disengaged with the disengagement levers.

Therefore, when a sheet that remains in the fixing unit or the section along the side of the image forming apparatus is removed, the holding of the pressure adjustment levers at the positions after the pushing down are desirably disengaged, and then the engagement with the main body of the image forming apparatus can be disengaged with the disengagement levers to open the guide.

That is to say, the conventional image forming apparatus described above has an issue that in a case where a sheet that remains in the fixing unit or the section along the side of the image forming apparatus is removed, the easiness of the work decreases.

SUMMARY OF THE INVENTION

An image forming apparatus according to an embodiment includes:

a fixing unit that includes a heating roller that heats a non-fixed image formed on a sheet, and a pressure roller that nips the sheet between the pressure roller and the heating roller to press the sheet, and fixes the non-fixed image to the sheet;

a housing that contains the fixing unit;

an exterior cover that is openably and closably provided for the housing, and forms an exterior of the image forming apparatus with the exterior cover closed;

a sheet guide member that is provided in the exterior cover, is openable and closable relative to the housing with the exterior cover opened, and occupies a close position where the sheet guide member is closed to guide a sheet that has passed through the fixing unit downstream in a sheet conveyance direction, and an open position where the sheet guide member is opened to allow access of a worker to the fixing unit;

a lock lever that is provided for the sheet guide member, and engages with the housing to lock the sheet guide member at the close position;

an operation lever that is provided for the sheet guide member under the lock lever in a vertical direction, moves the pressure roller at a first pressing position where the pressure roller presses the heating roller with a first pressing force, to a second pressing position where the pressure roller presses the heating roller with a second pressing force smaller than the first pressing force, rotates relative to the sheet guide member, is in a first orientation when the pressure roller is at the first pressing position, and is in a second orientation when the pressure roller is at the second pressing position, and rotates from the second orientation to the first orientation according to movement of the sheet guide member from the close position to the open position;

a first protrusion that protrudes from the sheet guide member between the lock lever and the operation lever, toward an exterior cover side; and a second protrusion that is at a position on the first protrusion closer to a front end of the first protrusion than a portion of the housing where the first protrusion is formed, and protrudes from an operation lever side of the first protrusion toward the operation lever side.

Further features of the present invention will become apparent from the following description of exemplary embodiments with reference to the attached drawings.

DESCRIPTION OF THE EMBODIMENTS

Hereinafter, exemplary embodiments of the present invention will be illustrated with reference to the drawings. However, sizes, materials, shapes, and relative arrangement of components described in the following exemplary embodiments should be appropriately modified according to a configuration of an apparatus to which the present invention is applied or various conditions. It is not intended that the scope of the present inventions is not limited to only the exemplary embodiments.

First Exemplary Embodiment

<Whole Configuration of Image Forming Apparatus>

Figure 1:
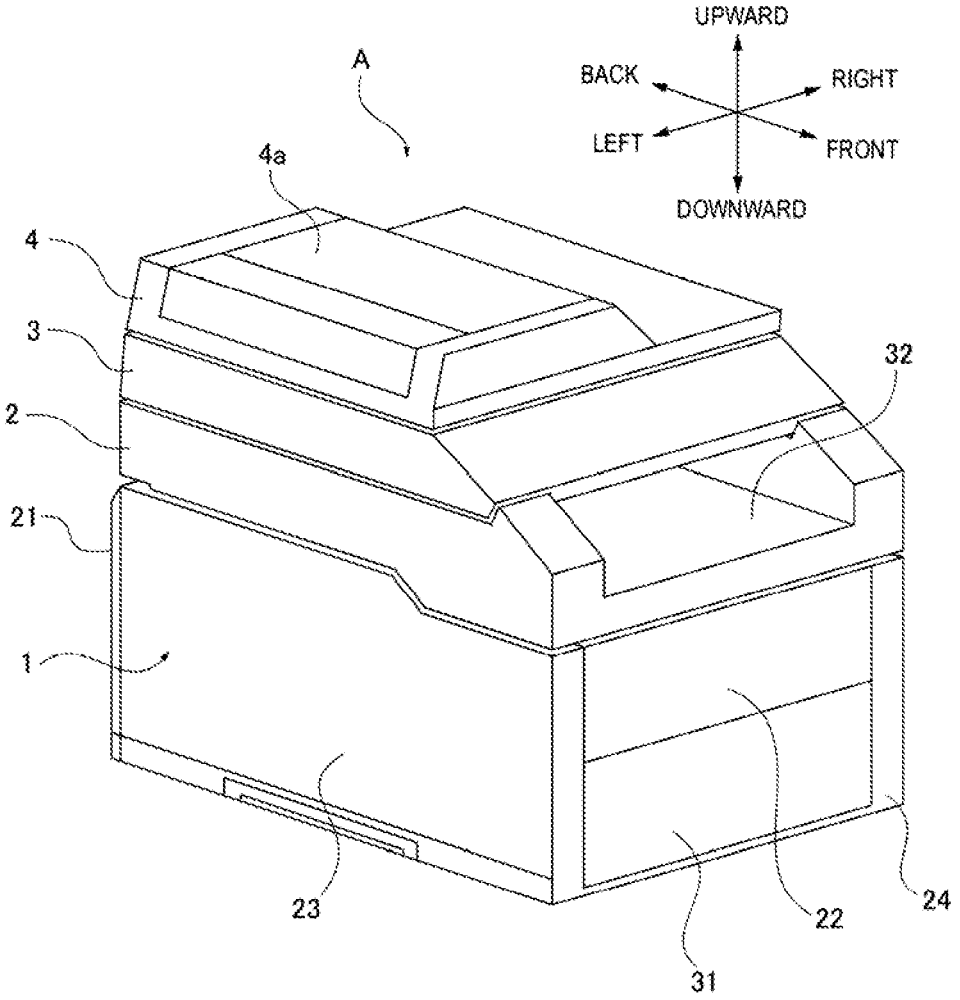
FIG. 1 is a perspective view illustrating an image forming apparatus at a time when a joint cover is at a placement position.
Figure 2:
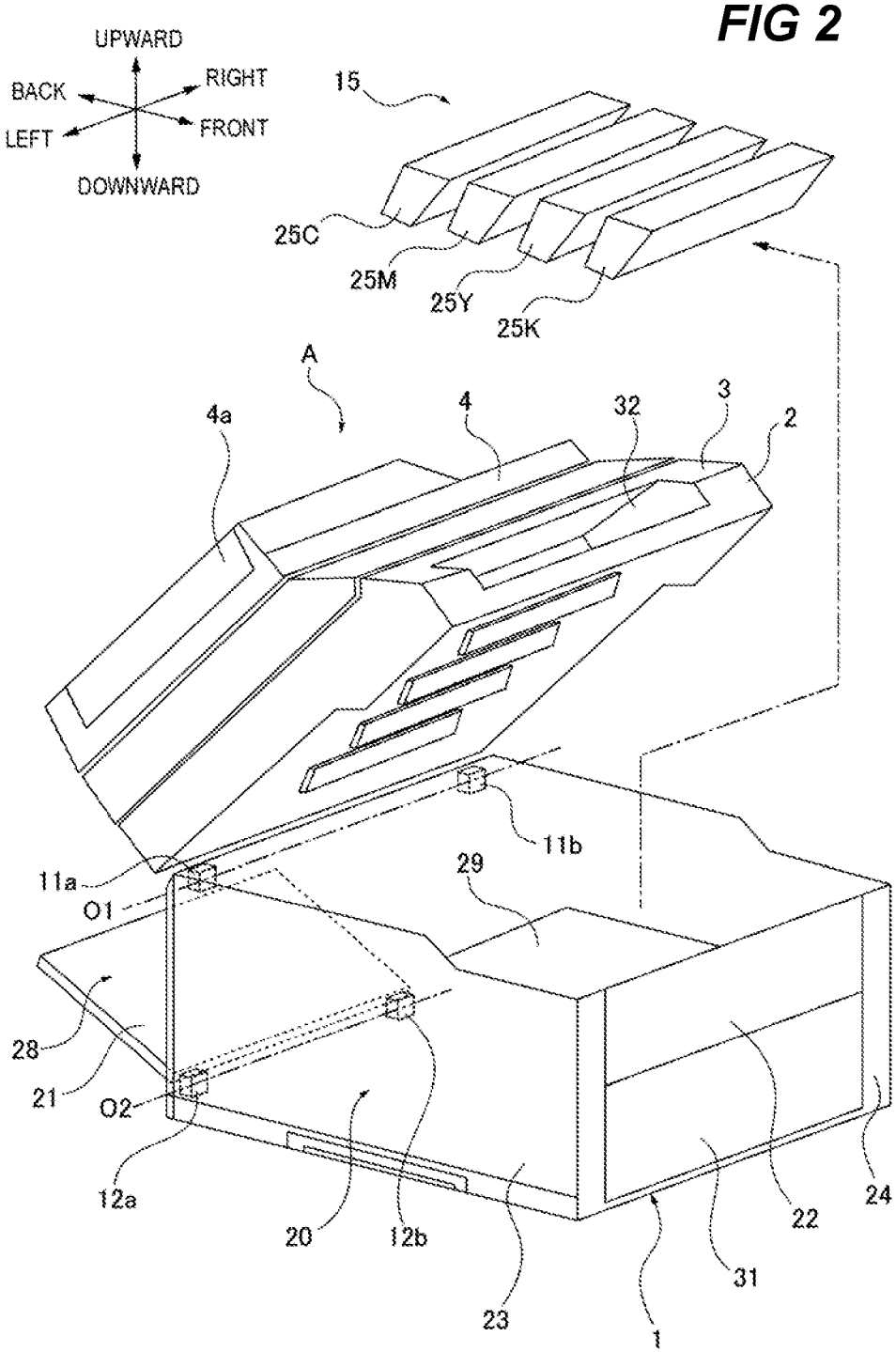
FIG. 2 is a perspective view illustrating the image forming apparatus at a time when the joint cover is at a separation position.
Figure 3:
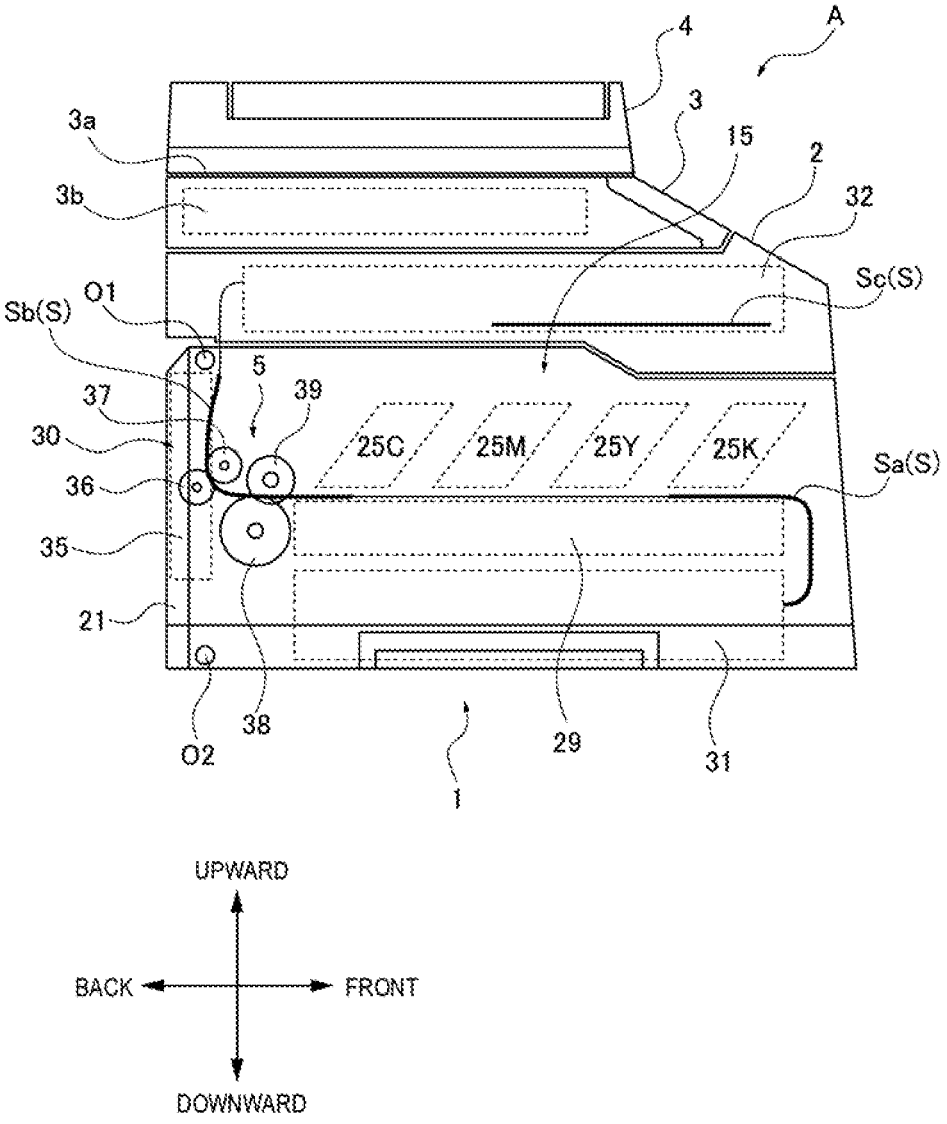
FIG. 3 is a schematic cross-sectional view illustrating the image forming apparatus in a normal mode.
Figure 4:
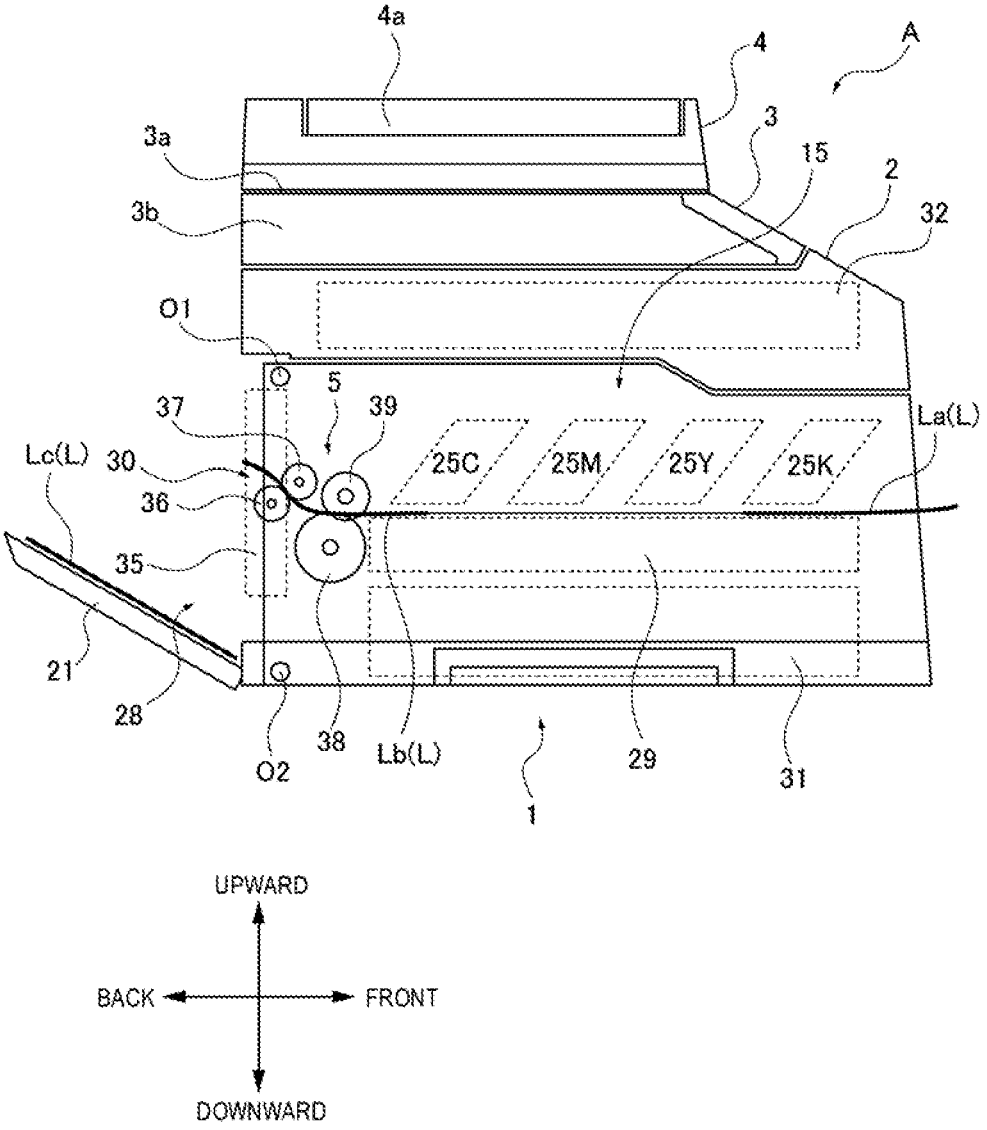
FIG. 4 is a schematic cross-sectional view illustrating the image forming apparatus in an envelope mode.

A whole configuration of an image forming apparatus A according to a first exemplary embodiment will be described with reference to FIGS. 1 to 4. FIG. 1 is a perspective view illustrating the image forming apparatus A at a time when a joint cover 2 is at a placement position. FIG. 2 is a perspective view illustrating the image forming apparatus A at a time when the joint cover 2 is at a separation position. FIG. 3 is a schematic cross-sectional view illustrating the image forming apparatus A at a time when the joint cover 2 is at the placement position. FIG. 4 is a schematic cross-sectional view illustrating the image forming apparatus A at a time when a rear cover 21 is at a separation position.

In FIG. 1, the front side of the image forming apparatus A is the downstream side of a direction in which a sheet tray 31 of the image forming apparatus A is drawn out, and is the opening side of a discharge tray 32. The back side of the image forming apparatus A is the upstream side of the direction in which the sheet tray 31 is drawn out. The left side of the image forming apparatus A is the left side of the image forming apparatus A seen from the front side. The right side of the image forming apparatus A is the right side of the image forming apparatus A seen from the front side. The upper side of the image forming apparatus A is the upper side in a vertical direction of the image forming apparatus A. The lower side of the image forming apparatus A is the lower side in the vertical direction of the image forming apparatus A. In this way, front, back, left, right, upward, and downward directions are illustrated in FIG. 1. Each direction illustrated in FIG. 2 and other drawings corresponds to each of the directions illustrated in FIG. 1. A horizontal direction that is a direction of an axis as a swing center described below is a left-right direction that perpendicularly crosses an up-down direction that is the vertical direction of the image forming apparatus A.

As illustrated in FIG. 1, the image forming apparatus A includes a printer portion 1 as an example of a housing, the joint cover 2 provided on the printer portion 1, a scanning device 3 provided on the joint cover 2, and an auto feeding device 4 provided on the scanning device 3.

As illustrated in FIG. 2, a pair of first hinge portions 11*a* and 11*b* is provided between the printer portion 1 and the joint cover 2, on the back sides of the printer portion 1 and the joint cover 2. The pair of first hinge portions 11*a* and 11*b* allows the printer portion 1 and the joint cover 2 to swing on a first axis O1. Consequently, the joint cover 2 provided on the printer portion 1 can swing on the first axis O1 that is in the horizontal direction that perpendicularly crosses the vertical direction on the back-side side of the printer portion 1. The joint cover 2 is configured to move between the placement position in which the joint cover 2 is placed on the printer portion 1, as illustrated in FIG. 1, and the separation position in which the joint cover 2 is upward separated from the printer portion 1 on the first axis O1, as illustrated in FIG. 2.

As illustrated in FIG. 2, replacement of each cartridge 25K, 25Y 25M, or 25C of an image forming portion 15 becomes possible by moving the joint cover 2 relative to the printer portion 1 to the separation position. Further, jam recovery of a sheet at a conveying belt 29 becomes possible by removing the cartridges 25K, 25Y, 25M, and 25C from the printer portion 1.

As illustrated in FIG. 2, the outside of the printer portion 1 is covered by a housing cover 20 made of resin and forming the exterior of the image forming apparatus A. The housing cover 20 includes a side cover 23 on the left, a side cover 24 on the right, a front cover 22 on the front, and the rear cover 21 on the back. The side cover 23 covers the left side of the printer portion 1. The side cover 24 covers the right side of the printer portion 1. As illustrated in FIG. 1, the sheet tray 31 is provided between the side covers 23 and 24 on the front side of the printer portion 1. The sheet tray 31 can be forward drawn out. The front cover 22 covers the front side of the printer portion 1 over the sheet tray 31. As illustrated in FIG. 2, the rear cover 21 as an exterior cover described below is swingably provided between the side covers 23 and 24 on the back side of the printer portion 1. The rear cover 21 is provided at a position that is opposite a sheet conveying portion 30 (see FIGS. 3 and 4) described below.

The printer portion 1 includes the image forming portion 15 that forms an image on a sheet, and a fixing unit 5 that fixes the image on the sheet. The image forming portion 15 includes the four cartridges 25K, 25Y, 25M, and 25C, as illustrated in FIG. 2. The cartridges 25K, 25Y, 25M, and 25C are arranged in the printer portion 1 at a front portion of the printer portion 1 that is apart from the first axis O1. The cartridges 25K, 25Y, 25M, and 25C are removably attached to the printer portion 1. The cartridge 25K corresponds to black. The cartridge 25Y corresponds to yellow. The cartridge 25M corresponds to magenta. The cartridge 25C corresponds to cyan. The cartridges 25K, 25Y, 25M, and 25C are arranged in this order along a sheet conveyance direction in which a sheet is conveyed by the conveying belt 29 illustrated in FIG. 3. Each of the cartridges 25K, 25Y, 25M, and 25C includes, in addition to a toner container, a photoconductor drum as an image bearing member, and a development device and a charging device as processing portions that act on the photoconductor drum. The charging device is a charging portion that uniformly charges the surface of the photoconductor drum. The development device is a development portion that develops a latent image formed on the surface of the photoconductor drum with the toner. Note that the processing portions that act on the photoconductor drum are not limited to the development device and the charging device. Each of the cartridges 25K, 25Y, 25M, and 25C is an example of a replacement portion that needs replacement.

The conveying belt 29 is provided in the printer portion 1. The conveying belt 29 is provided to the lower side of the image forming portion 15 in the vertical direction. The conveying belt 29 conveys a sheet fed from the sheet tray 31. Here, the conveying belt 29 is a conveying member (sheet bearing member) that bears and conveys a sheet. Therefore, the present image forming apparatus A is an image forming apparatus that transfers a toner image of each of the colors onto a sheet borne by the conveying belt 29 at the image forming portion 15 in a sequentially superimposed manner.

The fixing unit 5 includes a heating roller 39 as a heating member, and a pressure roller 38 as a pressure member pressed onto the heating roller 39 (see FIGS. 3 and 4). A sheet onto which an image (toner images) has been transferred on the conveying belt 29 is fed to the fixing unit 5. Then at the fixing unit 5, the heating roller 39 and the pressure roller 38 fix the image transferred on the conveying belt 29 to the sheet.

The sheet conveying portion 30 is also provided in the printer portion 1, on the back side of the printer portion 1. The sheet conveying portion 30 conveys the sheet to which the image has been fixed along a side of the printer portion 1 in the vertical direction. The sheet conveying portion 30 includes conveying rollers 36 and 37 that convey a sheet, and a sheet guide member 35 that guides a sheet. The conveying rollers 36 and 37 and the sheet guide member 35 will be described below. Then the sheet to which the image has been fixed is conveyed by the sheet conveying portion 30 to discharge the sheet to the discharge tray 32 provided to the upper side of the fixing unit 5 in the vertical direction.

As described above, the rear cover 21 as an exterior cover is provided between the side covers 23 and 24 included by the housing cover 20, on the back side of the printer portion 1. The rear cover 21 is provided at a position opposite the sheet conveying portion 30.

Here, the configuration of the printer portion 1 and the rear cover 21 will be described. As illustrated in FIG. 2, a pair of second hinge portions 12*a* and 12*b* is provided between the printer portion 1 and the rear cover 21, on the back side of the printer portion 1 and on the lower side of the rear cover 21. The pair of second hinge portions 12*a* and 12*b* allows the printer portion 1 and the rear cover 21 to swing on a second axis O2. Consequently, the rear cover 21 provided for the printer portion 1 can swing on the second axis O2 that is in the horizontal direction that perpendicularly crosses the vertical direction at the back-side side of the printer portion 1. Note that the second axis O2 of the rear cover 21 is to the lower side of the first axis O1 of the joint cover 2 in the vertical direction, on the back-side side of the printer portion 1.

The rear cover 21 is configured to swing between an engagement position where the rear cover 21 engages with the printer portion 1 as a housing to form an exterior of the image forming apparatus A (see FIG. 3), and a separation position where the rear cover 21 disengages from the printer portion 1 and is separated from the printer portion 1 (see FIG. 4). Here, at the separation position, the rear cover 21 functions as a tray on which a sheet fed from the fixing unit 5 is placed. Therefore, the separation position where the rear cover 21 is separated from the printer portion 1 is a placement position where a sheet fed from the fixing unit 5 is placed (see FIG. 4). A back opening 28 is formed in a back side of the printer portion 1. The back opening 28 exposes the sheet conveying portion 30 to the rear side when the rear cover 21 is at the separation position (placement position) illustrated in FIG. 4. In this way, the rear cover 21 can move between the engagement position where the rear cover 21 engages with the printer portion 1 to close the back opening 28 formed on the back-side side of the printer portion 1, and the separation position (placement position) where the rear cover 21 is separated from the printer portion 1 to open the back opening 28 of the printer portion 1. On the other hand, the rear cover 21 is into the close state to form a conveyance path to discharge a sheet having passed through the fixing unit 5 onto the discharge tray 32.

The scanning device 3 is placed on the joint cover 2, as illustrated in FIGS. 3 and 4. The scanning device 3 includes a placement plane 3*a* on which an original as a scanned object is placed, and a scanning portion 3*b* that scans an image of an original on the placement plane 3*a* while moving. Here, the scanning device 3 is configured to swing with the joint cover 2 when the joint cover 2 is swung relative to the printer portion 1.

The auto feeding device 4 is placed on the scanning device 3, as illustrated in FIGS. 3 and 4. The auto feeding device 4 includes an original feeding portion (not illustrated) and an auto original feeding portion 4*a*. The auto original feeding portion 4*a* separates originals loaded on the original feeding portion, one sheet by one sheet, and conveys the original to the scanning portion 3*b* that is at a stop position. While an original is conveyed by the auto original feeding portion 4*a*, the image is scanned by the scanning portion 3*b*, and then the original is discharged onto an original discharge portion (not illustrated).

Here, the scanning device 3 and the auto feeding device 4 are configured to swing with the joint cover 2 when the joint cover 2 is swung relative to the printer portion 1.

<Normal Mode and Envelope Mode>

A normal mode and an envelope mode of the image forming apparatus A will be described with reference to FIGS. 3 and 4. FIG. 3 is a schematic cross-sectional view illustrating the image forming apparatus A in the normal mode. FIG. 4 is a schematic cross-sectional view illustrating the image forming apparatus A in the envelope mode.

First, a sheet pass in the normal mode of the image forming apparatus A will be described with reference to FIG. 3. In the normal mode illustrated in FIG. 3, a sheet S is fed from the sheet tray 31, passes through the image forming portion 15, the fixing unit 5, and the sheet conveying portion 30, and is discharged onto the discharge tray 32. In FIG. 3, sheet positions Sa, Sb, and Sc each illustrate a sheet position.

In the normal mode, as illustrated with the sheet position Sa in FIG. 3, the sheet S is fed from the sheet tray 31, passes through a curved sheet conveyance path in the vertical direction, and then is fed to the image forming portion 15 provided to the upper side of the sheet tray 31 in the vertical direction.

Further, as illustrated with the sheet position Sb in FIG. 3, the sheet S passes through the image forming portion 15 in a horizontal direction, and passes through a nip portion of the pressure roller 38 and the heating roller 39, and a nip portion of the conveying rollers 36 and 37. After the sheet S passes through the nip portions, the sheet S is guided in the vertical direction along the sheet guide member 35 held at a position for guiding a sheet.

Further, as illustrated with the sheet position Sc in FIG. 3, after the sheet S is guided in the vertical direction, the sheet S is discharged onto the discharge tray 32 provided to the upper side of the fixing unit 5 in the vertical direction.

Next, a sheet pass in the envelope mode of the image forming apparatus A will be described with reference to FIG. 4. In the envelope mode illustrated in FIG. 4, a sheet S is fed from a multi-tray (not illustrated) on the front side of the image forming apparatus A, passes through the image forming portion 15, the fixing unit 5, and the conveying rollers 36 and 37 in a horizontal direction, and is discharged onto the rear cover 21 on the back side of the image forming apparatus A. In FIG. 4, envelope positions La, Lb, and Lc each illustrate a position of an envelope L as a sheet.

Since the envelope L is thicker than the sheet S in the normal mode, and has a narrower width in a width direction that perpendicularly crosses the sheet conveyance direction than the width of the sheet S in the normal mode, the envelope L may be damaged if the envelope L passes through the sheet conveyance path illustrated in FIG. 3 and curved in the vertical direction. Therefore, a sheet conveyance path in the horizontal direction illustrated in FIG. 4 is desirably formed to discharge the envelope L onto the rear cover 21 opened from the image forming apparatus A.

In the envelope mode, as illustrated with the envelope position La in FIG. 4, the envelope L is fed from the multi-tray (not illustrated) on the front side of the image forming apparatus A, and is fed to the image forming portion 15 in the horizontal direction.

Further, as illustrated with the envelope position Lb in FIG. 4, the envelope L passes through the image forming portion 15 in the horizontal direction, and passes through the nip portion of the pressure roller 38 and the heating roller 39, and the nip portion of the conveying rollers 36 and 37.

Further, as illustrated with the envelope position Lc in FIG. 4, the envelope L is discharged onto the rear cover 21 from the back side of the image forming apparatus A with the rear cover 21 opened.

<Fixing Unit and Sheet Conveying Portion>

Figure 5:
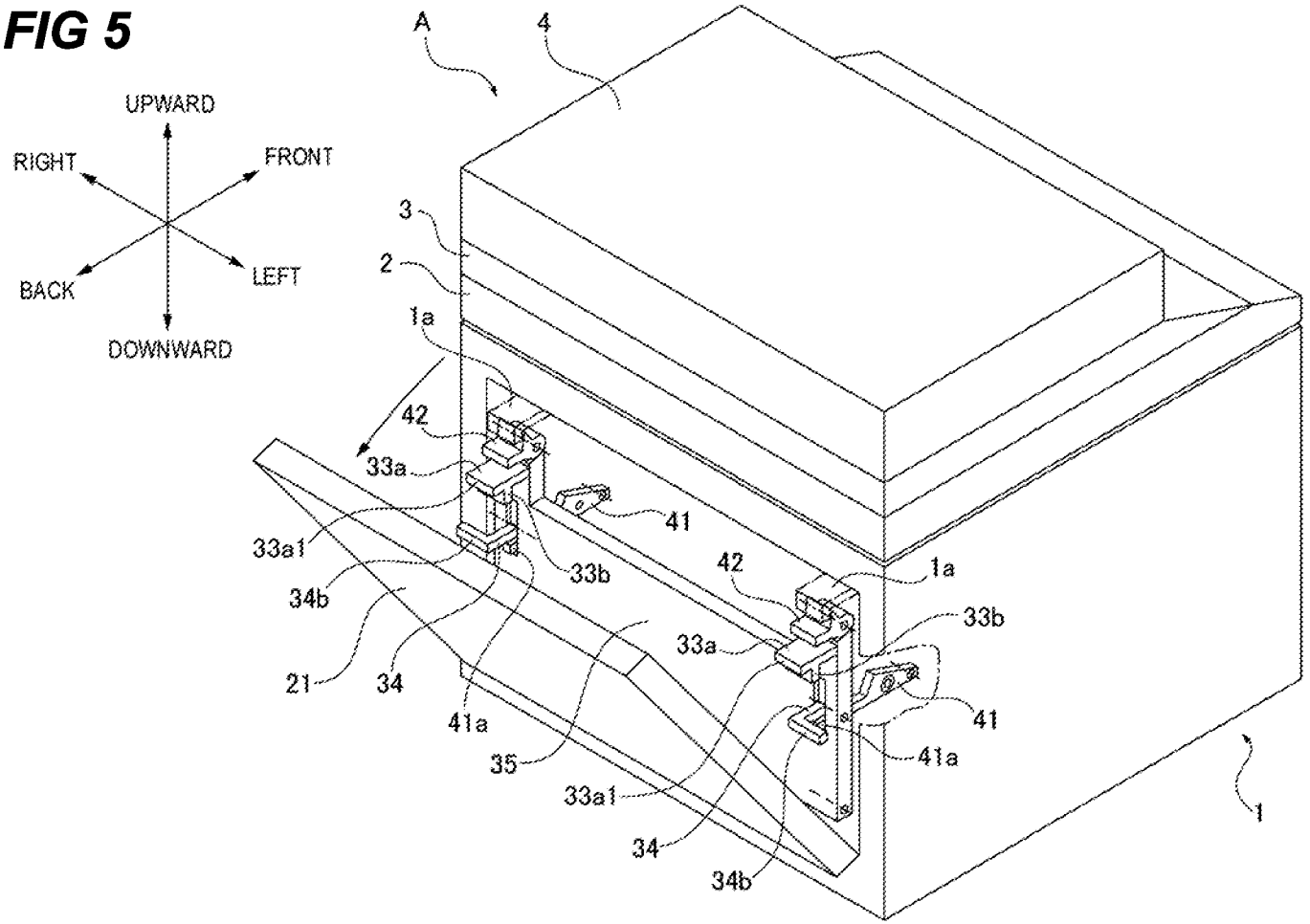
FIG. 5 is a perspective view illustrating the image forming apparatus according to a first exemplary embodiment with a sheet guide member closed.
Figure 6:
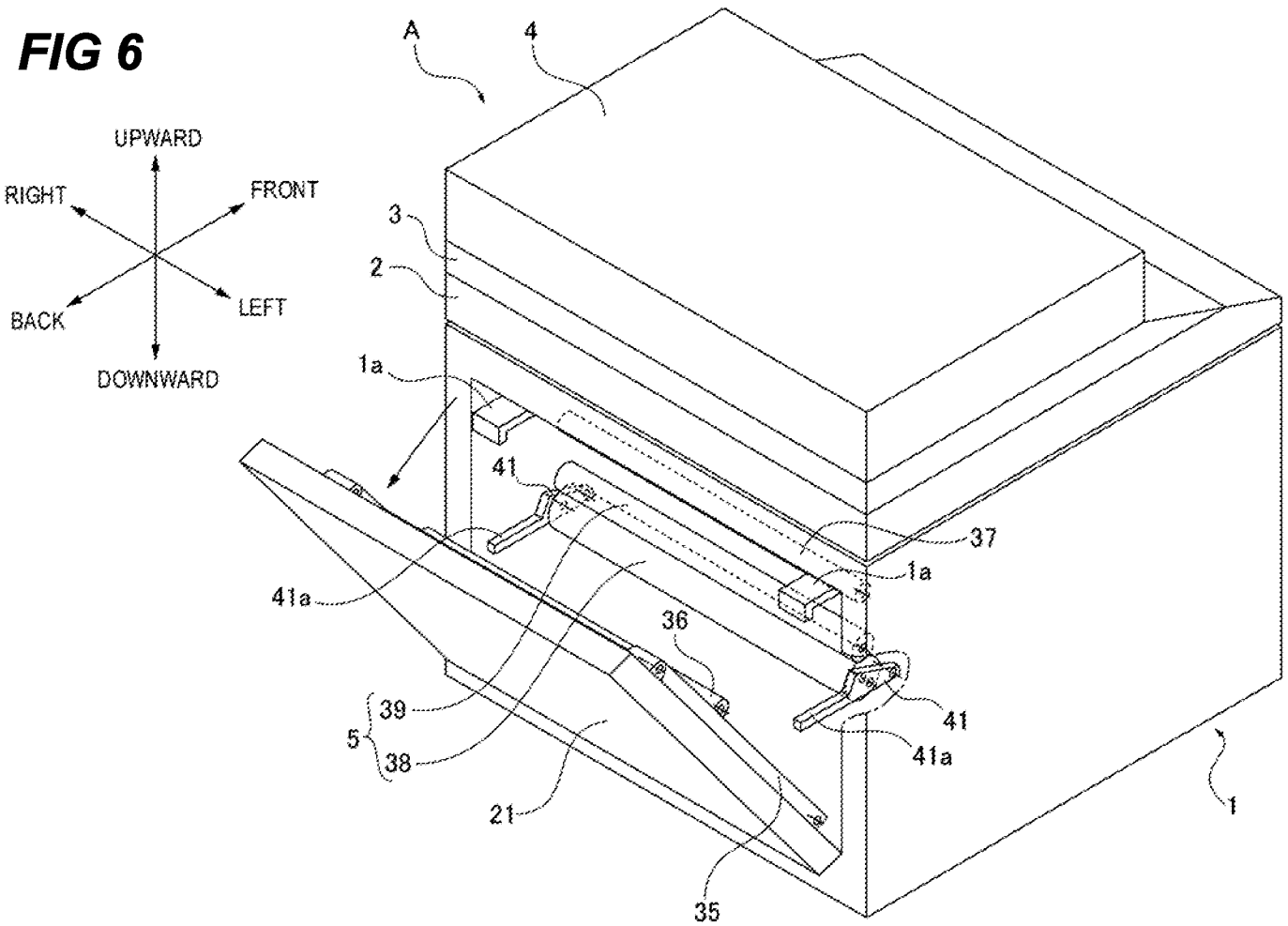
FIG. 6 is a perspective view illustrating the image forming apparatus according to the first exemplary embodiment with the sheet guide member opened.
Figure 7A:
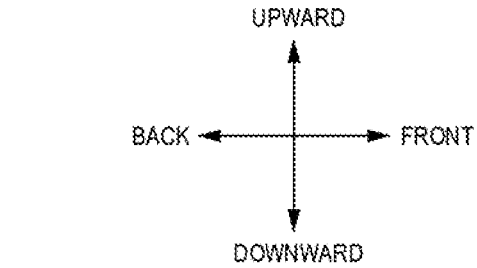
FIGS. 7A and 7B are drawings illustrating the sheet guide member of the image forming apparatus according to the first exemplary embodiment.
Figure 7B:
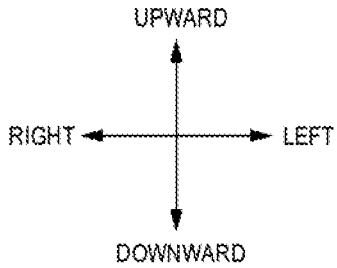
Figure 7B:
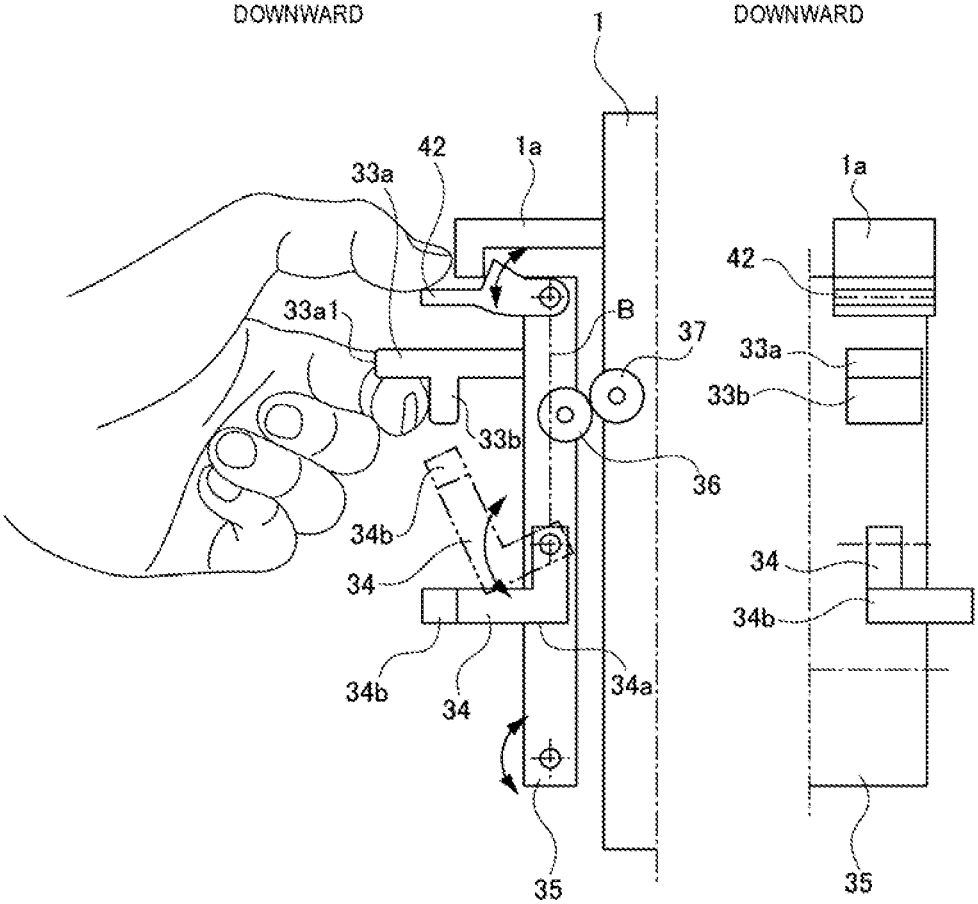
Figure 8:
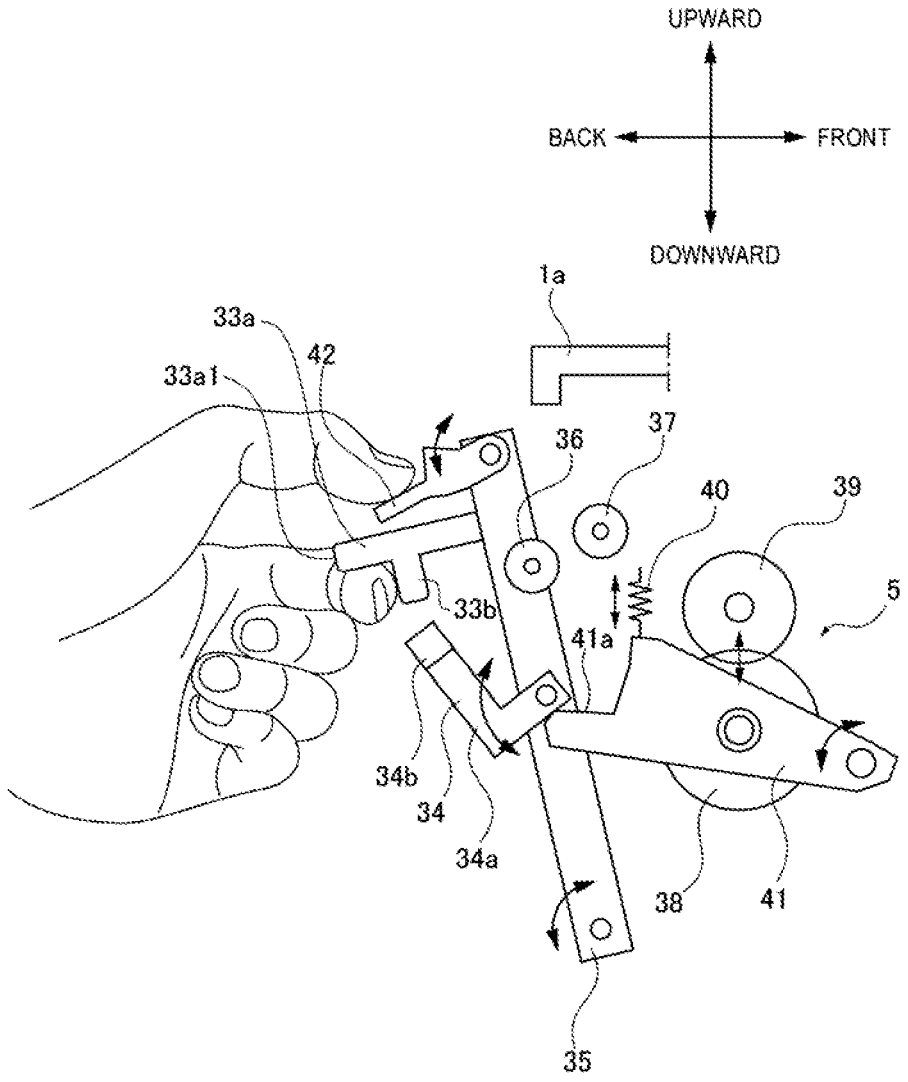
FIG. 8 is a drawing illustrating a nip pressure adjustment mechanism of the image forming apparatus according to the first exemplary embodiment.

Next, the fixing unit 5 and the sheet conveying portion 30 will be described with reference to FIGS. 5 to 8. FIG. 5 is a perspective view of the image forming apparatus A according to the present exemplary embodiment with the sheet guide member 35 closed. FIG. 6 is a perspective view of the image forming apparatus A according to the present exemplary embodiment with the sheet guide member 35 opened. FIG. 7A is a side view of the image forming apparatus A according to the present exemplary embodiment with the sheet guide member 35 closed. FIG. 7B is a rear view of the image forming apparatus A according to the present exemplary embodiment with the sheet guide member 35 closed. FIG. 8 is a drawing illustrating the sheet conveying portion 30 of the image forming apparatus A according to the present exemplary embodiment.

First, nip pressure adjustment of the fixing unit 5 will be described. As illustrated in FIG. 8, the fixing unit 5 includes the heating roller 39 as a heating member, and the pressure roller 38 as a pressure member pressed against the heating roller 39. The heating roller 39 is rotatably supported by the printer portion 1 as a housing. The pressure roller 38 is rotatably supported by a swing lever 41. One end of the swing lever 41 is swingably supported by the printer portion 1. The other end of the swing lever 41 has a receipt plane 41*a* that can abut on a pressure adjustment lever 34 described below. A support position of the swing lever 41 that supports the pressure roller 38 is between the one end and the other end. A biasing member 40 is provided between the swing lever 41 and the printer portion 1. The biasing member 40 presses the heating roller 39 and the pressure roller 38. The biasing member 40 is a spring. One end of the biasing member 40 is attached to the swing lever 41. The other end of the biasing member 40 is attached to the printer portion 1.

The pressure adjustment lever 34 is an operation lever that moves the pressure roller 38 at a first pressing position where the pressure roller 38 is pressed against the heating roller 39 with a first pressing force, to a second pressing position illustrated in FIG. 5 where the pressure roller 38 is pressed with a second pressing force smaller than the first pressing force. More specifically, the pressure adjustment lever 34 is swingably provided for the sheet guide member 35 described below. The pressure adjustment lever 34 is swung to abut on the swing lever 41 supporting the pressure roller 38, and push down the swing lever 41 against a biasing force of the biasing member 40 to move the pressure roller 38 to the second pressing position.

The pressure adjustment lever 34 has a cam plane 34*a* that abuts on the receipt plane 41*a* of the swing lever 41 at a position where the pressure roller 38 is pushed down to the second pressing position. Since the cam plane 34*a* abuts on the receipt plane 41*a*, the pressure adjustment lever 34 is held at the position where the pressure roller 38 is pushed down to the second pressing position. Further, the pressure adjustment lever 34 is swung to disengage the abutment between the cam plane 34*a* of the pressure adjustment lever 34 and the receipt plane 41*a* of the swing lever 41 to move the pressure roller 38 to the first pressing position by a biasing force (returning force) of the biasing member 40.

<Sheet Conveying Portion>

Next, the sheet conveying portion 30 will be described. As described above, the sheet conveying portion 30 includes the conveying rollers 36 and 37 that convey a sheet, and the sheet guide member 35 that guides a sheet.

The sheet guide member 35 is provided between the fixing unit 5 and the rear cover 21 (see FIGS. 3 and 4). The sheet guide member 35 is swingably provided for the printer portion 1. The sheet guide member 35 is configured to move between a guide position where the sheet guide member 35 guides a sheet fed from the fixing unit 5, in the vertical direction (a close position illustrated in FIG. 5), and a retraction position where the sheet guide member 35 retracts from the guide position (an open position illustrated in FIG. 6). The sheet guide member 35 can occupy the close position where the sheet guide member 35 is closed to guide a sheet that has passed through the fixing unit 5 downstream in the sheet conveyance direction, and the open position where the sheet guide member 35 is opened to allow a worker to access the fixing unit 5.

The conveying rollers 36 and 37 nip and convey a sheet fed from the fixing unit 5. The conveying roller 37 that is one of the conveying rollers 36 and 37 is supported on the printer portion 1 side. The conveying roller 36 that is the other one opposite the conveying roller 37 is supported by the sheet guide member 35. Therefore, when the sheet guide member 35 is held at the guide position, the conveying roller 36 on the sheet guide member 35 side is made to abut on the conveying roller 37 on the printer portion 1 side (see FIGS. 7A and 7B). On the other hand, when the sheet guide member 35 is retracted to the retraction position from the guide position, the conveying roller 36 on the sheet guide member 35 side is separated from the conveying roller 37 on the printer portion 1 side (see FIG. 6).

The sheet guide member 35 is provided with a disengagement lever (lock lever) 42 that disengageably engages with an engaged portion 1*a* on the printer portion 1 side as a housing. The disengagement lever 42 engages with the engaged portion 1*a* on the printer portion 1 side to hold the sheet guide member 35 at the guide position (see FIGS. 7A and 7B). In other words, the disengagement lever (lock lever) 42 engages with the printer portion 1 as a housing to lock the sheet guide member 35 at the close position. On the other hand, the disengagement lever 42 disengages from the engaged portion 1*a* on the printer portion 1 side to allow the sheet guide member 35 to move from the guide position to the retraction position (see FIG. 8).

The pressure adjustment lever 34 as an operation lever is swingably provided for the sheet guide member 35. In the sheet guide member 35 held at the guide position, the pressure adjustment lever 34 is provided to the lower side of the disengagement lever 42 in the vertical direction (see FIGS. 7A and 7B). The pressure adjustment lever 34 moves the pressure roller 38 at the first pressing position where the pressure roller 38 is pressed against the heating roller 39 with the first pressing force, to the second pressing position where the pressure roller 38 is pressed with the second pressing force smaller than the first pressing force. When the pressure roller 38 is at the first pressing position, the pressure adjustment lever 34 is in a first orientation. When the pressure roller 38 is at the second pressing position, the pressure adjustment lever 34 is in a second orientation. That is to say, the pressure adjustment lever 34 is rotated from the first orientation to the second orientation to move the pressure roller 38 from the first pressing position to the second pressing position. Further, the pressure adjustment lever 34 is rotated from the second orientation to the first orientation to move the pressure roller 38 from the second pressing position to the first pressing position.

The sheet guide member 35 is provided with a first protrusion. The first protrusion is provided with a second protrusion. Here, the first protrusion and the second protrusion are a first rib 33*a* and a second rib 33*b* that have sheet-like shapes and have widths in a rotational axis direction of the disengagement lever 42.

As illustrated in FIG. 7B, the pressure adjustment lever 34 is arranged under the first rib 33*a*. When both FIGS. 5 and 7B are seen, the first rib 33*a* and the pressure adjustment lever 34 are arranged in such a manner that the first rib 33*a* and the pressure adjustment lever 34 overlap each other when the first rib 33*a* is seen along the vertical direction. In the present exemplary embodiment, the first rib 33*a* and the pressure adjustment lever 34 are opposite each other.

The second protrusion is closer to the front-end side of the first protrusion than a portion of the first protrusion attached to the printer portion 1. In other words, the second protrusion is arranged at a position closer to the front end of the first protrusion than the root (base) portion of the first protrusion. In the present exemplary embodiment, the second protrusion is separated from the root (base) portion of the first protrusion to form a gap. Note that the second protrusion may adjoin both the first protrusion and a portion of the printer portion 1 where the first protrusion is formed.

In this way, since the second protrusion is formed at an intermediate portion of the first protrusion, a finger of a worker is prevented from entering the root portion of the first protrusion beyond necessity when the worker puts the finger on the first protrusion.

The first rib 33*a* is provided between the disengagement lever 42 and the pressure adjustment lever 34 of the sheet guide member 35. The first rib 33*a* protrudes in a perpendicular direction toward the rear cover 21 side from a straight line B connecting the rotational center of the disengagement lever 42 with the rotational center of the pressure adjustment lever 34. The second rib 33*b* is provided on the pressure adjustment lever 34 side of the first rib 33*a*, that is to say the operation lever side of the first rib 33*a*. The second rib 33*b* protrudes toward the pressure adjustment lever 34 side. The second rib 33*b* is provided closer to the sheet guide member 35 side than an end 33*a*1, on the rear cover 21 side, of the first rib 33*a* is provided, in the perpendicular direction. In addition, the second rib 33*b* is provided at a position outside the rotational path of a knob end of a knob 34*b* of the pressure adjustment lever 34. Here, the knob end of the knob 34*b* of the pressure adjustment lever 34 is an end, on the upper side in the vertical direction, of the knob 34*b* of the pressure adjustment lever 34 illustrated with a dash double-dot line in FIG. 7A.

Consequently, even if, when the disengagement lever 42 is operated, the first rib 33*a* is also pinched, the pinched position is restricted by the second rib 33*b*, and an entry into the rotational area of the pressure adjustment lever 34 is restricted.

The first rib 33*a* is provided to the lower side of the disengagement lever 42 in the vertical direction, that is to say a rotational direction that disengages engagement of the disengagement lever 42. Therefore, a user can grasp the disengagement lever 42 and the first rib 33*a* with the fingers to operate the disengagement lever 42 in the disengagement direction.

The first rib 33*a* is provided to the upper side of the pressure adjustment lever 34 in the vertical direction, that is to say a rotational direction of the pressure adjustment lever 34 that moves the pressure roller 38 from the second pressing position to the first pressing position. Therefore, a user can grasp the pressure adjustment lever 34 and the first rib 33*a* with the fingers to operate the pressure adjustment lever 34.

A pair of the disengagement levers 42, a pair of the pressure adjustment levers 34, and a pair of the first ribs 33*a* including a pair of the second ribs 33*b* are provided on both sides of a width direction (left-right direction) that perpendicularly crosses the sheet conveyance direction. Further, the disengagement levers 42, the pressure adjustment levers 34, and the first ribs 33*a* including the second ribs 33*b* are provided outside the conveyance area of a sheet in the width direction of a sheet. Further, similarly as the disengagement levers 42 on the sheet guide member 35 side, a pair of the engaged portions 1*a* on the printer portion 1 side is provided on both sides of the width direction (left-right direction) that perpendicularly crosses the sheet conveyance direction. Further, the engaged portions 1*a* are provided outside the conveyance area of a sheet in the width direction of a sheet. Consequently, the disengagement levers 42, the pressure adjustment levers 34, the first ribs 33*a* including the second ribs 33*b*, and the engaged portions 1*a* do not hinder conveyance of a sheet.

<Positional Relationship Between Each Lever>

Here, the positional relationship between each of the disengagement lever 42, the first rib 33*a*, and the pressure adjustment lever 34 in the vertical direction of the image forming apparatus A will be described with numerical values.

First, a distance from the rotational center of the disengagement lever 42 to an end plane of the first rib 33*a* (plane on the disengagement lever 42 side) is desirably 10 mm as a stroke of operation of the disengagement lever 42 grasped with fingers in the disengagement direction. The reason is that if the distance is smaller than 10 mm, the disengagement lever 42 cannot be separated from the sheet guide member 35.

Next, a distance from the rotational center of the pressure adjustment lever 34 to an end plane of the first rib 33*a* (plane on the pressure adjustment lever 34 side) is desirably 15 mm as a stroke of operation of the pressure adjustment lever 34 grasped with fingers in the direction that pushes up the pressure adjustment lever 34. The reason is that if the distance is smaller than 15 mm, the pressure adjustment lever 34 cannot be separated from the sheet guide member 35.

<Jam Recovery Procedure>

A jam recovery procedure in a case where a sheet remains in the fixing unit 5 or the sheet conveying portion 30 will be described.

First, a jam recovery procedure in a case where a sheet remains in the fixing unit 5 or the sheet conveying portion 30 in a sheet pass in the normal mode will be described.

An example of conditions in which jam occurs is a case where a sheet is left in the sheet tray 31 in high humidity for about a few days, the sheet absorbs moisture, and the whole sheet enlarges. Another example is a case where after a sheet passes through the fixing unit 5, the moisture of the sheet decreases only on the heating roller 39 side, and only one side of the sheet becomes short.

As a result, the sheet is curled due to the difference between the front side length and back side length of the sheet. Therefore, the sheet may stick in the nip portion of the conveying rollers 36 and 37 of the sheet conveying portion 30, and the jam may occur.

In a case of the jam recovery in the normal mode, first, the rear cover 21 is rotated into an open state in which the rear cover 21 is opened relative to the printer portion 1, as illustrated in FIG. 5, to allow operation of the disengagement levers 42.

Next, the disengagement levers 42 are operated in the disengagement direction, as illustrated in FIGS. 7A and 7B. As described above, the first ribs 33*a* are provided to the lower side of the disengagement levers 42 in the vertical direction, that is to say a rotational direction that disengages engagement of the disengagement levers 42. Therefore, the disengagement levers 42 and the first ribs 33*a* can be grasped with fingers to operate the disengagement levers 42 in the disengagement direction. Consequently, since engagement of the disengagement levers 42 with the printer portion 1 side is disengaged, the sheet guide member 35 can move to the retraction position, and jam recovery can be performed.

Note that in the normal mode, the pressure adjustment levers 34 are at positions before pushing down. At this time, the pressure adjustment levers 34 do not abut on the swing levers 41, and the biasing members 40 press the pressure roller 38 against the heating roller 39 by the first pressing force. Therefore, operation of the pressure adjustment levers 34 is not necessary.

Next, a jam recovery procedure in a case where a sheet remains in the fixing unit 5 or the sheet conveying portion 30 in a sheet pass in the envelope mode will be described.

In a case of jam recovery in the envelope mode, the disengagement levers 42 are operated in the disengagement direction, similarly as the normal mode. As described above, the first ribs 33*a* are provided to the lower side of the disengagement levers 42 in the vertical direction, that is to say a rotational direction that disengages engagement of the disengagement levers 42. Therefore, a user can grasp the disengagement levers 42 and the first ribs 33*a* with the fingers to operate the disengagement levers 42 in the disengagement direction.

At this time, the pressure adjustment levers 34 are held at positions where the pressure adjustment levers 34 push down the swing levers 41. In this case, biasing forces of the biasing members 40 that press the heating roller 39 and the pressure roller 38 act on the pressure adjustment levers 34 held at the positions where the pressure adjustment levers 34 push down the swing levers 41. Therefore, even if, when the sheet guide member 35 is opened, engagement with the engaged portions 1*a* on the printer portion 1 side is disengaged with the disengagement levers 42, forces acting on the pressure adjustment levers 34 act as loads that maintain the orientation of the sheet guide member 35.

However, since the first ribs 33*a* are provided to the lower side of the disengagement levers 42 in the vertical direction, that is to say a rotational direction that disengages engagement of the disengagement levers 42, operation that disengages the disengagement levers 42 can be operated by grasping the disengagement levers 42 and the first ribs 33*a* with fingers. Therefore, even if the forces acting on the pressure adjustment levers 34 act as loads that maintain the orientation of the sheet guide member 35, engagement with the engaged portions 1*a* on the printer portion 1 side can be disengaged with the disengagement levers 42 to move the sheet guide member 35 from the guide position to the retraction position.

At the time of the operation, the rotation of the sheet guide member 35 is accompanied by rotation of the pressure adjustment levers 34 in a direction that disengages abutment between the cam planes 34*a* of the pressure adjustment levers 34 and the receipt planes 41*a* of the swing levers 41. Therefore, biasing forces of the biasing members 40 act on the pressure adjustment levers 34 through the swing levers 41 to rotate the pressure adjustment levers 34 to the positions before pushing down. However, the first ribs 33*a* are provided with the second ribs 33*b* to restrict an entry into the rotational areas of the pressure adjustment levers 34 at the time of the operation described above. Consequently, the operation procedure is shortened, and the easiness of the work is improved.

Alternatively, in a case of jam recovery in the envelope mode, the following operation may be performed.

First, the pressure adjustment levers 34 and the first ribs 33*a* are grasped with fingers to operate the pressure adjustment levers 34. As described above, the first ribs 33*a* are provided to the upper side of the pressure adjustment levers 34 in the vertical direction, that is to say a rotational direction of the pressure adjustment levers 34 that moves the pressure roller 38 from the second pressing position to the first pressing position. Therefore, the pressure adjustment levers 34 and the first ribs 33*a* can be grasped with fingers to operate the pressure adjustment levers 34 in a direction that disengages abutment between the pressure adjustment levers 34 and the swing levers 41.

Next, the disengagement levers 42 and the first ribs 33*a* are grasped with fingers to operate the disengagement levers 42 in the disengagement direction. As described above, the first ribs 33*a* are provided to the lower side of the disengagement levers 42 in the vertical direction, that is to say a rotational direction that disengages engagement of the disengagement levers 42. Therefore, the disengagement levers 42 and the first ribs 33*a* can be grasped with fingers to disengage engagement between the disengagement levers 42 and the printer portion 1 to move the sheet guide member 35 to the retraction position.

In this way, jam recovery in the envelope mode also can be smoothly performed according to the procedure.

As described above, the easiness of the work in a case where a remaining sheet is removed is improved according to the present exemplary embodiment. Further, jam recovery is smoothly performed according to the procedure.

Second Exemplary Embodiment

Figure 9:
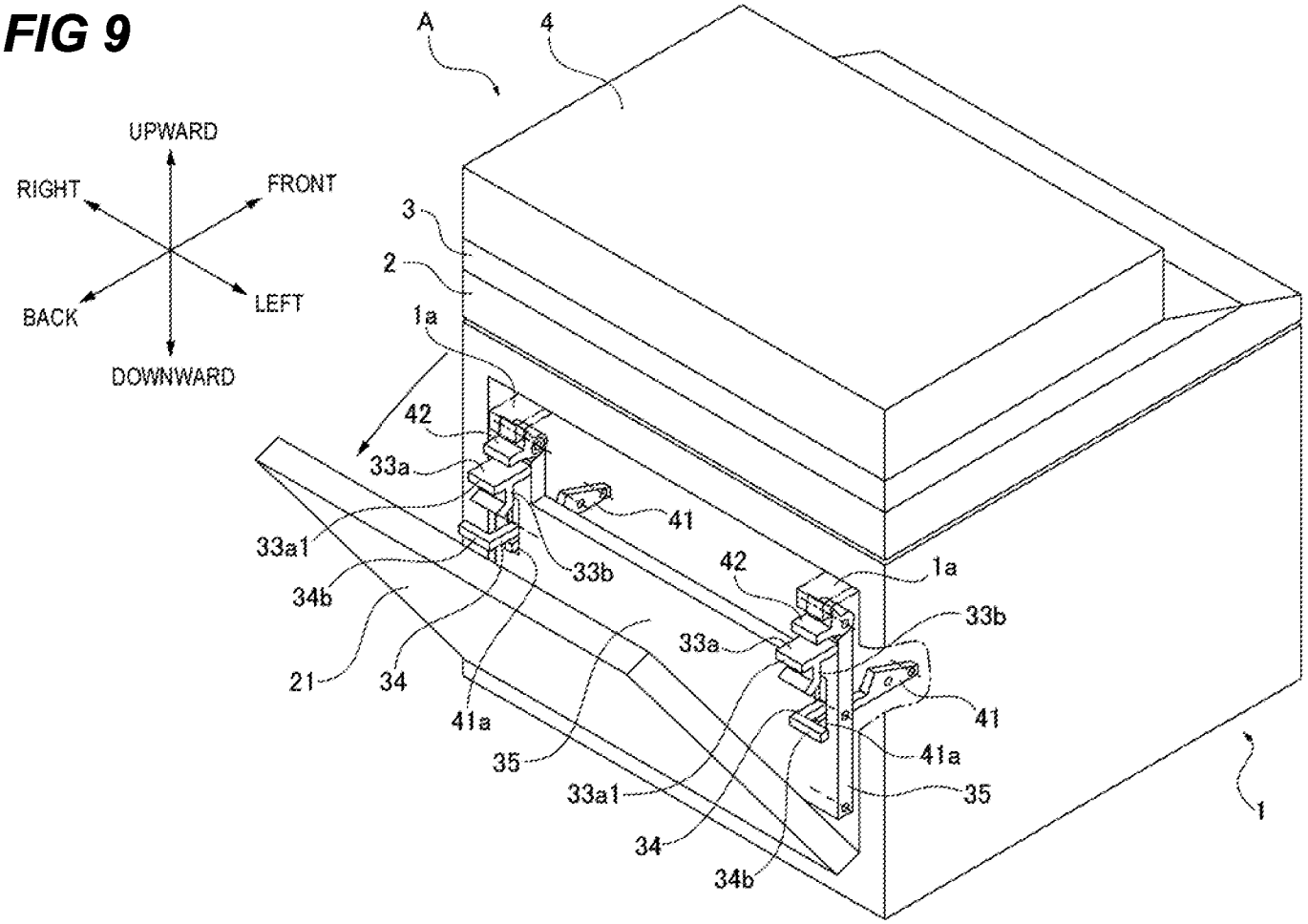
FIG. 9 is a perspective view illustrating an image forming apparatus according to a second exemplary embodiment with a sheet guide member closed.
Figures 10A, 10B:
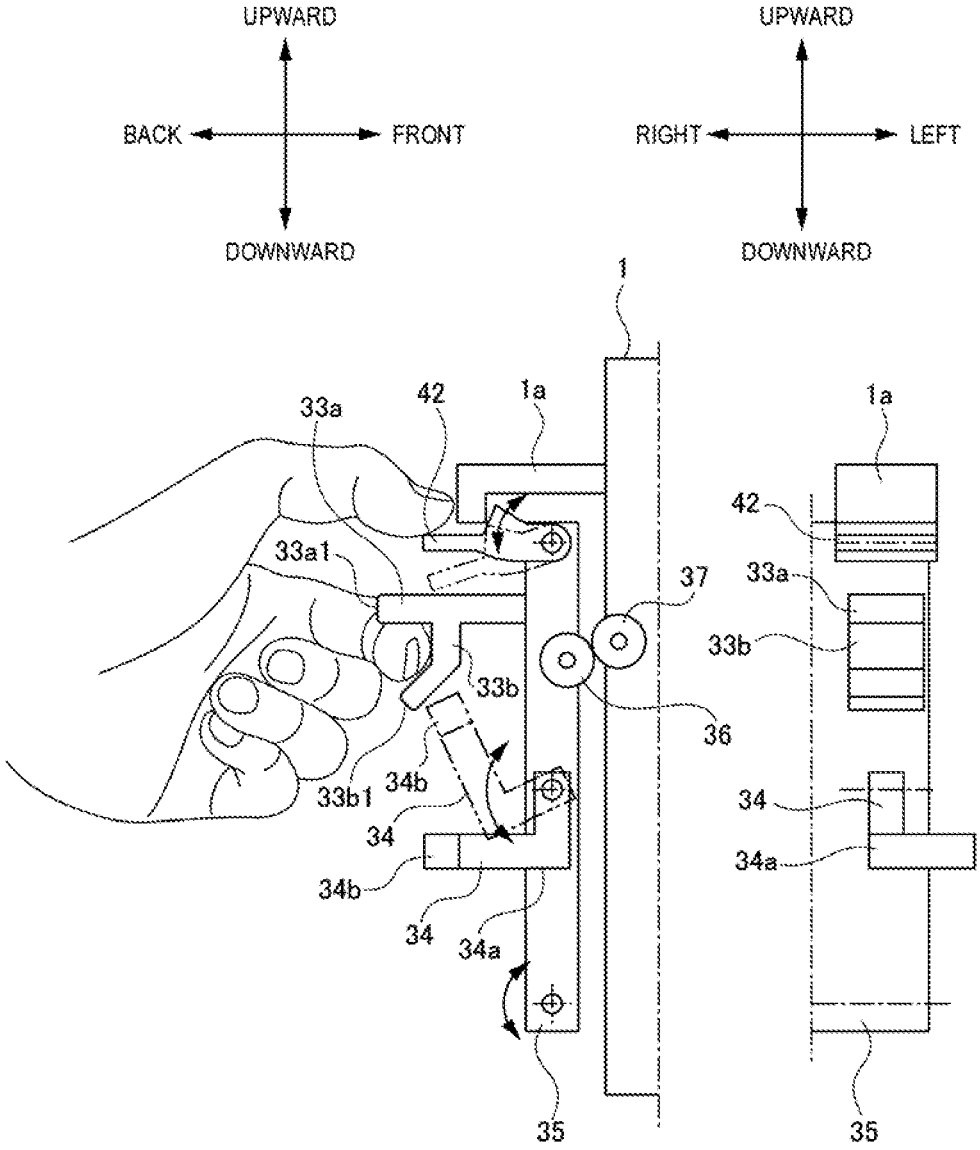
FIGS. 10A and 10B are drawings illustrating a sheet guide member of the image forming apparatus according to the second exemplary embodiment.

An image forming apparatus A according to a second exemplary embodiment will be described with reference to FIGS. 9, 10A, and 10B. FIG. 9 is a perspective view of the image forming apparatus A according to the second exemplary embodiment with a sheet guide member 35 closed. FIG. 10A is a side view of the image forming apparatus A according to the second exemplary embodiment with the sheet guide member 35 closed. FIG. 10B is a rear view of the image forming apparatus A according to the second exemplary embodiment with the sheet guide member 35 closed.

In the present exemplary embodiment, as illustrated in FIGS. 9, 10A, and 10B, in addition to the configuration of the first exemplary embodiment described above, second ribs 33*b* that are second protrusions provided for first protrusions, and knobs 34*b* of pressure adjustment levers 34 are configured as described below. Note that the configuration except the second ribs 33*b* and the knobs 34*b* is similar to the configuration of the exemplary embodiment described above, and thus the description is omitted here.

As illustrated in FIG. 10A, the second rib 33*b* is provided with an end 33*b*1 on the lower side in the vertical direction, with the sheet guide member 35 held at the guide position. The end 33*b*1 is to the lower side of a knob end of the knob 34*b* of the pressure adjustment lever 34 in the vertical direction when a pressure roller 38 is at the first pressing position. That is to say, a front end of the second rib 33*b* and the pressure adjustment lever 34 are arranged in such a manner that the front end of the second rib 33*b* and the pressure adjustment lever 34 overlap each other when the second rib 33*b* is seen along a direction perpendicular to the vertical direction and the rotational axis direction of the pressure roller 38 if the pressure adjustment lever 34 is in the first orientation. Here, the knob end of the pressure adjustment lever 34 at a time when the pressure roller 38 is at the first pressing position is an end, on the upper side in the vertical direction, of the knob 34*b* of the pressure adjustment lever 34 illustrated with a dash double-dot line in FIG. 10A.

Further, as illustrated in FIG. 10B, the knob 34*b* of the pressure adjustment lever 34 is provided outside the conveyance area of a sheet in a width direction that perpendicularly crosses the sheet conveyance direction, and protrudes more outside than the second rib 33*b*.

Further, the knob 34*b* of the pressure adjustment lever 34 is desirably exposed at least 10 mm from the second rib 33*b* to the outside in the width direction that perpendicularly crosses the sheet conveyance direction. The reason is that the size of a finger (the diameter of a finger) of an adult is generally defined as Φ10 mm, and it is difficult to grasp the pressure adjustment lever 34 if the exposure is less than 10 mm.

Consequently, even if the knob 34*b* of the pressure adjustment lever 34 is covered by the second rib 33*b* in the vertical direction, the knob 34*b* protrudes outward from the second rib 33*b* in the width direction of a sheet. Therefore, even if rotation of the sheet guide member 35 to the retraction position is accompanied by disengagement of abutment between the pressure adjustment lever 34 and the swing lever 41, an entry into the rotational area of the pressure adjustment lever 34 is restricted by the second rib 33*b*. Further, the second rib 33*b* does not hinder operation of the pressure adjustment lever 34.

Note that a jam recovery procedure is similar to the jam recovery procedure according to the first exemplary embodiment described above, and thus the description is omitted here.

As described above, in the present exemplary embodiment, the easiness of the work in a case where a remaining sheet is removed is improved similarly as the exemplary embodiment described above.

Another Exemplary Embodiment

In the exemplary embodiments described above, the first rib 33*a* (see FIGS. 7A and 7B) is provided between the disengagement lever 42 and the pressure adjustment lever 34 of the sheet guide member 35, and the first rib 33*a* is a first protrusion protruding in the perpendicular direction toward the rear cover 21 side from the straight line B connecting the rotational center of the disengagement lever 42 and the rotational center of the pressure adjustment lever 34 However, the present invention is not limited to the configuration.

For example, in addition to the configurations of the exemplary embodiments described above, a sheet guide member may be provided with third protrusions. Although not illustrated, the third protrusions may be provided as described below.

The third protrusion is provided between a disengagement lever and a first protrusion of the sheet guide member. The third protrusion protrudes in a perpendicular direction toward the exterior cover side from a straight line connecting the rotational center of the disengagement lever and the rotational center of an operation lever.

The third protrusion is provided to the lower side of the disengagement lever in the vertical direction, that is to say a rotational direction that disengages engagement of the disengagement lever.

The third protrusion is desirably provided at least 10 mm apart from the first protrusion in the vertical direction.

Similarly as the first protrusion and second protrusion, the third protrusion is a rib that has a sheet-like shape and has a width in a rotational axis direction of the disengagement lever. Hereinafter, the third protrusion is referred to as a third rib.

<Positional Relationship Between Each Lever>

Here, the positional relationship between each of the disengagement lever, the third rib, a first rib, and a pressure adjustment lever in the vertical direction of an image forming apparatus will be described with specific numerical values.

First, a distance from the rotational center of the disengagement lever to an end plane of the third rib (plane on the disengagement lever side) is desirably 10 mm as a stroke of operation of the disengagement lever grasped with fingers in the disengagement direction. The reason is that if the distance is smaller than 10 mm, the disengagement lever cannot be separated from the sheet guide member.

Next, a distance from the rotational center of the pressure adjustment lever to an end plane of the first rib (plane on the pressure adjustment lever side) is desirably 15 mm as a stroke of operation of the pressure adjustment lever grasped with fingers in a direction that pushes up the pressure adjustment lever. The reason is that if the distance is smaller than 15 mm, the pressure adjustment lever cannot be separated from the sheet guide member.

A distance between an end plane of the third rib (plane on the first rib side) and an end plane of the first rib (plane on the third rib side) is desirably 10 mm. The reason is that the size of a finger (the diameter of a finger) of an adult is generally defined as Φ10 mm.

<Jam Recovery Procedure>

A jam recovery procedure in a case where a sheet remains in a fixing unit or a sheet conveying portion will be described.

First, a jam recovery procedure in a case where a sheet remains in the fixing unit or the sheet conveying portion in a sheet pass in the normal mode will be described.

In a case of the jam recovery in the normal mode, first, a rear cover is rotated into an open state in which the rear cover is opened relative to a printer portion to allow operation of the disengagement levers.

Next, the disengagement levers are operated in the disengagement direction. As described above, the third ribs are provided to the lower side of the disengagement levers in the vertical direction, that is to say a rotational direction that disengages engagement of the disengagement levers. Therefore, the disengagement levers and the third ribs can be grasped with fingers to operate the disengagement levers in the disengagement direction. Consequently, since engagement of the disengagement levers with the printer portion side is disengaged, the sheet guide member can move to the retraction position, and jam recovery can be performed.

Note that in the normal mode, the pressure adjustment levers are at positions before pushing down. At this time, the pressure adjustment levers do not abut on swing levers, and biasing members press a pressure roller against a heating roller by the first pressing force. Therefore, operation of the pressure adjustment levers is not necessary.

Next, a jam recovery procedure in a case where a sheet remains in the fixing unit or the sheet conveying portion in a sheet pass in the envelope mode will be described.

In a case of jam recovery in the envelope mode, the disengagement levers are operated in the disengagement direction, similarly as the normal mode. As described above, the third ribs are provided to the upper side of the first ribs in the vertical direction, and to the lower side of the disengagement levers in the vertical direction, that is to say a rotational direction that disengages engagement of the disengagement levers. Therefore, a user can grasp the disengagement levers and the third ribs with the fingers to operate the disengagement levers in the disengagement direction.

At this time, the pressure adjustment levers are held at positions where the pressure adjustment levers push down the swing levers. In this case, biasing forces of the biasing members that press the heating roller and the pressure roller act on the pressure adjustment levers held at the positions where the pressure adjustment levers push down the swing levers. Therefore, even if, when the sheet guide member is opened, engagement with engaged portions on the printer portion side is disengaged with the disengagement levers, forces acting on the pressure adjustment levers act as loads that maintain the orientation of the sheet guide member.

However, since the third ribs are provided to the lower side of the disengagement levers in the vertical direction, that is to say a rotational direction that disengages engagement of the disengagement levers, operation that disengages the disengagement levers can be operated by grasping the disengagement levers and the third ribs with fingers. Therefore, even if the forces acting on the pressure adjustment levers act as loads that maintain the orientation of the sheet guide member, engagement with the engaged portions on the printer portion side can be disengaged with the disengagement levers, and further the sheet guide member can be moved from the guide position to the retraction position.

At the time of the operation, the rotation of the sheet guide member is accompanied by rotation of the pressure adjustment levers in a direction that disengages abutment between cam planes of the pressure adjustment levers and receipt planes of the swing levers. Therefore, biasing forces of the biasing members act on the pressure adjustment levers through the swing levers to rotate the pressure adjustment levers to the positions before pushing down. However, since the first ribs are provided between the third ribs and the pressure adjustment levers, an entry into the rotational areas of the pressure adjustment levers is restricted at the time of the operation described above. Consequently, the operation procedure is shortened, and the easiness of the work is improved also in this case.

Alternatively, in a case of jam recovery in the envelope mode, the following operation may be performed.

In a case of jam recovery in the envelope mode, the disengagement levers are operated in the disengagement direction, similarly as the normal mode. Although, as described in the exemplary embodiment described above, the first ribs are provided to the lower side of the third ribs in the vertical direction, the first ribs are provided to the lower side of the disengagement levers in the vertical direction, that is to say a rotational direction that disengages engagement of the disengagement levers. Therefore, a user can grasp the disengagement levers and the first ribs, instead of the disengagement levers and the third ribs, with the fingers to operate the disengagement levers in the disengagement direction.

At the time of the operation, the rotation of the sheet guide member is accompanied by rotation of the pressure adjustment levers in a direction that disengages abutment between the cam planes of the pressure adjustment levers and the receipt planes of the swing levers. Therefore, biasing forces of the biasing members act on the pressure adjustment levers through the swing levers to rotate the pressure adjustment levers to the positions before pushing down. However, the first ribs are provided with second ribs to restrict an entry into the rotational areas of the pressure adjustment levers at the time of the operation described above. Consequently, the operation procedure is shortened, and the easiness of the work is improved also in this case.

Alternatively, in a case of jam recovery in the envelope mode, the following operation may be performed.

First, the pressure adjustment levers and the first ribs are grasped with fingers to operate the pressure adjustment levers. As described above, the first ribs are provided to the lower side of the third ribs in the vertical direction, and to the upper side of the pressure adjustment levers in the vertical direction, that is to say a rotational direction of the pressure adjustment levers that moves the pressure roller from the second pressing position to the first pressing position. Therefore, a user can grasp the pressure adjustment levers and the first ribs with the fingers to operate the pressure adjustment levers in a direction that disengages abutment between the pressure adjustment levers and the swing levers.

Next, the disengagement levers and the third ribs are grasped with fingers to operate the disengagement levers in the disengagement direction. As described above, the third ribs are provided to the upper side of the first ribs in the vertical direction, and to the lower side of the disengagement levers in the vertical direction, that is to say a rotational direction that disengages engagement of the disengagement levers. Therefore, a user can grasp the disengagement levers and the third ribs with the fingers to disengage engagement between the disengagement levers and the printer portion to move the sheet guide member to the retraction position.

In this way, jam recovery in the envelope mode also can be smoothly performed according to the procedure.

As described above, according to the present exemplary embodiment, the easiness of the work in a case where a remaining sheet is removed is improved similarly as the exemplary embodiments described above. Further, jam recovery is smoothly performed according to the procedure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-206771, filed Dec. 14, 2020, which is hereby incorporated by reference herein in its entirety.

What is claimed is:

1. An image forming apparatus comprising:

a fixing unit that includes a heating roller that heats a non-fixed image formed on a sheet, and a pressure roller that nips the sheet between the pressure roller and the heating roller to press the sheet, and fixes the non-fixed image to the sheet;

a housing that contains the fixing unit;

an exterior cover that is openably and closably provided for the housing, and forms an exterior of the image forming apparatus with the exterior cover closed;

a sheet guide member that is provided in the exterior cover, is openable and closable relative to the housing with the exterior cover opened, and occupies a close position where the sheet guide member is closed to guide a sheet that has passed through the fixing unit downstream in a sheet conveyance direction, and an open position where the sheet guide member is opened to allow access of a worker to the fixing unit;

a lock lever that is provided for the sheet guide member, and engages with the housing to lock the sheet guide member at the close position;

an operation lever that is provided for the sheet guide member under the lock lever in a vertical direction, moves the pressure roller at a first pressing position where the pressure roller presses the heating roller with a first pressing force, to a second pressing position where the pressure roller presses the heating roller with a second pressing force smaller than the first pressing force, rotates relative to the sheet guide member, is in a first orientation when the pressure roller is at the first pressing position, and is in a second orientation when the pressure roller is at the second pressing position, and rotates from the second orientation to the first orientation according to movement of the sheet guide member from the close position to the open position;

a first protrusion that protrudes from the sheet guide member between the lock lever and the operation lever, toward an exterior cover side; and a second protrusion that is at a position on the first protrusion closer to a front end of the first protrusion than a portion of the housing where the first protrusion is formed, and protrudes from an operation lever side of the first protrusion toward the operation lever side.

2. The image forming apparatus according to claim 1, wherein the first protrusion and the operation lever are arranged in such a manner that the first protrusion and the operation lever overlap each other when the first protrusion is seen along the vertical direction.

3. The image forming apparatus according to claim 1, wherein the portion of the housing where the first protrusion is formed is separated from the second protrusion.

4. The image forming apparatus according to claim 1 further comprising:

a support member that supports the pressure roller rotatably, and swings on one end side of the support member as a swing center; and a spring that is provided for the support member on another end side of the support member, and applies a force to the support member to allow the pressure roller to press the heating roller, wherein the operation lever presses the support member against a returning force of the spring to move the pressure roller from the first pressing position to the second pressing position.

5. The image forming apparatus according to claim 4, wherein the pressure roller is under the heating roller in the vertical direction.

6. The image forming apparatus according to claim 4, wherein the spring is more compressed when the pressure roller is at the first pressing position than when the pressure roller is at the second pressing position.

7. The image forming apparatus according to claim 1, wherein the second protrusion and a front end of the operation lever are at overlapping positions when the second protrusion is seen along a direction perpendicular to both the vertical direction and a rotational axis direction of the pressure roller, with the sheet guide member at the close position, and with the pressure roller at the first pressing position.

8. The image forming apparatus according to claim 1, wherein a front end of the operation lever extends toward an outside of the image forming apparatus in a rotational axis direction of the pressure roller.

9. The image forming apparatus according to claim 8, wherein the front end of the operation lever protrudes at least 10 mm from the second protrusion.

* * * * *